US005787509A

United States Patent [19]

Alvera

[11] Patent Number: 5,787,509

[45] **Date of Patent: *Aug. 4, 1998**

[54] STOCKING HAVING A COMFORT FOOT AREA

[76] Inventor: Lee A. Alvera, 150 E. 30th St., Apt 2B, New York, N.Y. 10016

[ * ] Notice: The term of this patent shall not extend beyond the expiration date of Pat. No. 5,671,482.

[21] Appl. No.: 819,115

[22] Filed: Mar. 17, 1997

Related U.S. Application Data

[63] Continuation of Ser. No. 322,450, Oct. 11, 1994, Pat. No. 5,671,482.

[51] Int. Cl.[6] ..... A41B 11/02

[52] U.S. Cl. ..... 2/241; 66/102

[58] Field of Search ..... 2/239, 241, 240, 2/242; 66/178 R, 182, 183, 184, 185, 186, 187, 196; 139/383 R, 384 R, 383 B

[56] References Cited

U.S. PATENT DOCUMENTS

| | | | |
|---|---|---|---|
| 1,942,152 | 1/1934 | Sauer | 2/239 |
| 2,010,936 | 8/1935 | Van Arnsdale et al. | 2/239 |
| 2,325,977 | 8/1943 | Pickels et al. | 2/239 |
| 2,798,281 | 7/1957 | Herzog | 2/239 |
| 3,013,564 | 12/1961 | Levey | 2/241 |
| 4,240,160 | 12/1980 | Imboden | 2/239 |
| 4,836,110 | 6/1989 | Giesick | 2/239 |

*Primary Examiner*—C. D. Crowder
*Assistant Examiner*—Larry D. Worrell, Jr.
*Attorney, Agent, or Firm*—Young & Basile, P.C.

[57] ABSTRACT

A fine hosiery stocking has a comfort foot area. The comfort area encompasses the toe, sole and heel areas of the foot. A pad is sized to cover and be secured to the comfort area or integrally knit or woven into the comfort area to act as a liner to protect and comfort the foot of the wearer of the stocking. The pad is made out of a thicker, absorbent fiber material to absorb wetness and allow the foot to breathe.

7 Claims, 4 Drawing Sheets

STOCKING HAVING A COMFORT FOOT AREA

CROSS-REFERENCE TO RELATED APPLICATION

This application is a continuation of U.S. Ser. No. 08/322,450, filed Oct., 11, 1994 now U.S. Pat. No. 5,671,482.

BACKGROUND OF THE INVENTION

This invention generally relates to footwear, land in particular, the invention relates to a nylon-type stocking that has cotton or the like integrally woven with the nylon-type material on the toe, sole and heel area of the stocking.

In the construction of a typical nylon type stocking, there is a single material from the leg of the user down to the toe. Modern dress codes, as implicit as they are, require women to wear nylon type hosiery whenever they wear a dress or skirt. The solos of the hosiery, although often doubled or tripled in thickness, are still normally uncomfortable. The nylon tends to slip and slide within the shoe and does not have much absorbency for perspiration.

Nylon or the like stockings are also worn by both men and women for medical reasons such as varicose veins, gout or poor circulation. These stockings are typically worn underneath pants, and the user puts conventional socks over the stockings before putting on shoes.

Many manufacturers have tried to improve on this discomfort and support problem in the field of socks. Some have added leather or suede soles over the existing cloth, whereas others have put inserts of polyurethane, polyester or plastic foam inside the stocking.

Many of these inventions have improved the user's predicament, but have not relieved the problem of slippage in the shoe, or have added a problem of creating an uncomfortable bulk within the shoe of the wearer U.S. Pat. No. 832,550 issued to Lepper discloses a sock with a combined insole and retaining device. The retaining device is inserted into a standard hose or sock and allows the user to use a medicated pad to prevent or heal callouses, corns and the like. The device can also be worn on the outside of the hose, but in either case, is separate from the hose.

U.S. Pat. No. 4,852,272 issued to Chilewich adhered a suede sole to a slipper sock by sewing the suede over a conventional sock. This is an improvement over Lepper, but because of the bulk, is not easily wearable inside a shoe.

While many of these earlier patents were directed to structures which improve the comfort and wearability of a sock or slipper sock, none of these patents teach a fully satisfactory structure for being able to wear the sock in a dress shoe, or being able to use the insert with nylon-type hosiery.

Other sock or hosiery patents, such as U.S. Pat. No. 1,293,399 issued to Fry; U.S. Pat. No. 2,319,577 issued to Baird, and U.S. Pat. No. 1,106,208 issued to Hale, teach other sock and hosiery constructions which incorporate one or more features of a stocking having a comfort area. None, however, teach the construction of the present invention which is more comfortable in use because of the unique and novel combination of features.

Foreign Patents such as Nos. 240,178 and 955,048 from the United Kingdom and Patent Nos. 1.288.805 and 1.361.146 from France all discuss improved socks or slippers. None teach having a conventional nylon-like hosiery for the upper portion of the garment and a thicker, more comfortable type of material used on the lower, sole area of the sock or stocking.

Numerous innovations for stockings have been provided in the prior art that are described as follows. Even though these innovations may be suitable for the specific individual purposes which they address, they differ from the present invention as hereinafter contrasted.

U.S. Pat. No. 4,277,959 issued to Thorneburg discloses athletic socks particularly suitable for jogging and running and having shock absorber cushion pads in the heel, ball, and in the inner portion of the arch area. The socks are formed by a sufficiently greater amount of yarn being knit in these portions than the amount of yarn knit in the outer portion of the arch. The shock absorber cushion pads protect and cushion the heel, ball and inner portion of the arch of the wearer's foot and reduce the shock normally imparted to the heel, ball and inner portion of the arch of the foot so that normal articulation of the bones in the feet takes place when the wearer is jogging and running. However, this invention rails to disclose a fine hosiery stocking providing added comfort or support, while enabling a person to wear a dress or dress clothes.

U.S. Pat. No. 5,133,088 issued to Dunlap discloses a formable or "puff" ink to form a friction producing surface on the back or the sock above the heel. However, this invention fails to disclose a comfort material such as cotton or the like integrally woven within the sole of the stocking which improves on the comfort of the user's feet as well as a decrease in slippage in the shoe.

U.S. Pat. No. 4,373,361 issued to Thorneburg discloses a ski sock which includes additional yarn Knit in plated relationship with the body yarns to form a thickened fabric area extending down the front portion of the leg of the sock to cushion and protect the front portion of the leg of the wearer from discomfort caused by the front and upper edge of the ski boot. The ski sock also includes a thickened fabric area extending along the rear half of the sock and at least through the heel and sole area to cushion and protect the heel and lower portion of the foot of the wearer. However, this reference fails to disclose any type of fine hosiery providing comfort, absorbency or support from his or her stocking, i.e. nylons, while being able to wear dress clothes and dress shoes.

U.S. Pat. No. 4,216,662 issued to Harris, Jr. et al. discloses a circular knit sock having a leg and upper foot portion knitted from a body yarn in a conventional stitch pattern, and a lower foot portion knitted from a combination of the body yarn and an auxiliary or reinforcement yarn of a second fiber content in a cushion stitch which has: (1) a first set of alternating courses knitted from the body yarn; (2) a second set of alternating courses knitted from a combination of the body and reinforcement yarns; (3) a first set of alternating wales formed of plain stitch loops made from a combination of the body yarn and the auxiliary yarn; and (4) a second set of alternating wales formed of successive tuck stitches made from the combined auxiliary and body yarns of one course and the body yarn of the preceding or adjacent course. However, this reference fails to disclose any type or fine hosiery such as nylons.

U.S. Pat. No. 4,615,188 issued to Hursh et al. discloses a knit sock, especially for jogging or other athletic activity, having a foot portion consisting of a first inner layer or ply disposed inside a second outer layer or ply. The first ply of the foot portion has an inner surface adapted to contact the skin formed principally of yarns having high frictional characteristics, high thermal conductivity, and low moisture regain (hydrophobic). Its opposed surface is formed principally of yarns having relatively low frictional characteristics. The second ply has an inner surface which has low frictional characteristics and its outer surface is formed of yarns having relatively high frictional characteristics and high moisture regain (hydrophilic). The latter surface may also be formed with terry loops to enhance its shock-absorbing construction as well as to increase its moisture absorbing capacity. However, this reference also fails to disclose any type of fine hosiery such as nylons.

Thus, it is an object of the present invention to provide a fine hosiery stocking which advantageously provides comfort to the bottom area of the foot. It is a further object of the present invention to provide such a fine hosiery stocking which also advantageously provides slip-resistance and increased perspiration absorbency. Yet further, it is an object of the present invention to provide such a fine hosiery stocking which advantageously appears to be a conventional fine hosiery stocking when the wearer's shoes are on, thus being aesthetically pleasing to the eye. A further object of the present invention is to provide a method of weaving the cushioning fabric, such as cotton or wool, into the nylon as not to overly increase the overall bulk of the stocking. A still further object is to provide a stocking having a comfort area that is economical in cost to manufacture.

SUMMARY OF THE INVENTION

The present invention addressed and solves the above-mentioned problems and meets the enumerated objects and advantages, as well as others not enumerated, by providing a stocking having a comfort foot area. The invention is fine hosiery, such as nylon, with the sole having a more comfortable material, such as cotton, integrally knit or woven throughout. It may be constructed as two separate parts integrally woven or unit together. The present invention provides walking comfort to the wearer of the stocking, while being, at the same time, more durable and more resilient to chemical auto deterioration in the presence of normal or abnormal excretion and exhalation of the epidermis than that of conventional nylon-type hosiery alone.

The typical nylon or synthetic hosiery is of the same material all down the leg and over the foot. The present invention integrally weaves the foot area with a more comfortable type of material such as cotton or wool. This material has a cushioning effect on the foot along with greater absorbency of perspiration. The ability to wear this hosiery all day while helping reduce the likelihood of developing callouses or medical problems is a great advantage to most females who are required to wear nylon-type hosiery with dresses, or men or women who are required to wear nylons because of health reasons.

In keeping With the above-mentioned objects, and with others which will become apparent hereinafter, one feature of the present invention resides in an absorbent fiber pad sewn into the foot area covering the heel, sale and toe areas, thereby absorbing wetness and allowing the foot to breathe. Another feature of the present invention is the pad acting as a liner to protect and comfort the bottom of a foot of a wearer of the stocking. Still another Feature of the present invention is the ability of the wearer to wear dress clothes and dress shoes while wearing the stockings. A further embodiment of the comfort area may comprise a variation thereof useful for certain dress shoes, for example, a stocking having a comfort area consisting or primarily the ball and toe areas of the sole to be worn with openbacked shoes.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
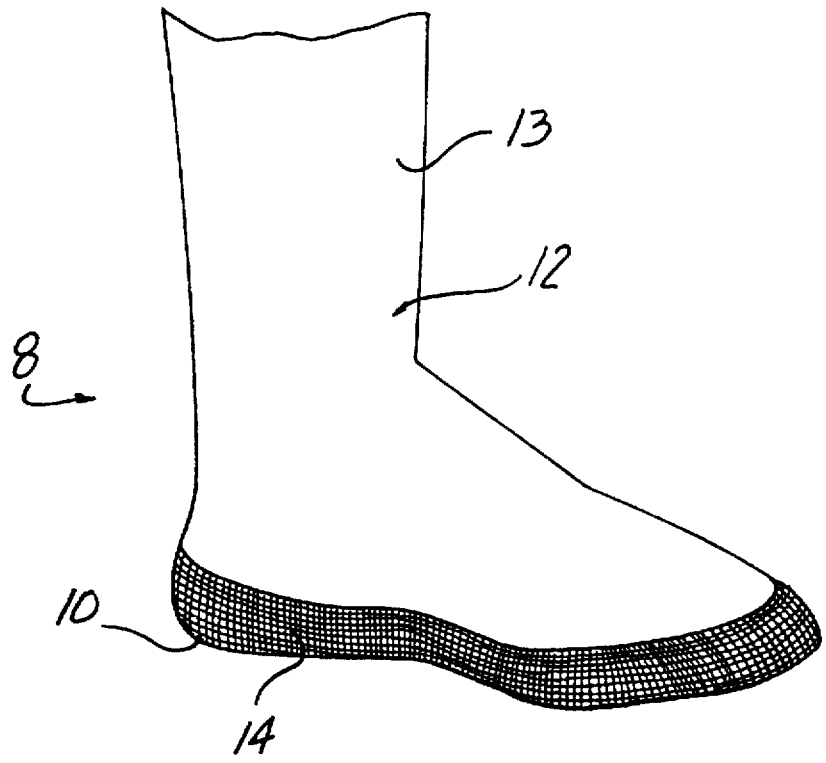
FIG. 1 is a side view of the stocking having a comfort foot area.
Figure 2:
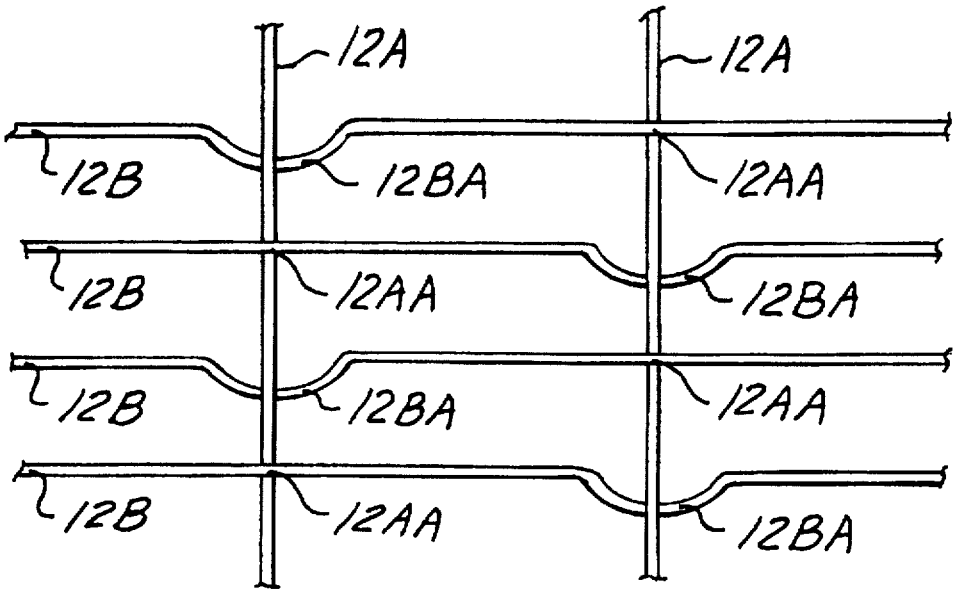
FIG. 2 is a magnified view showing the normal weave of the nylon-type hosiery.
Figure 3:
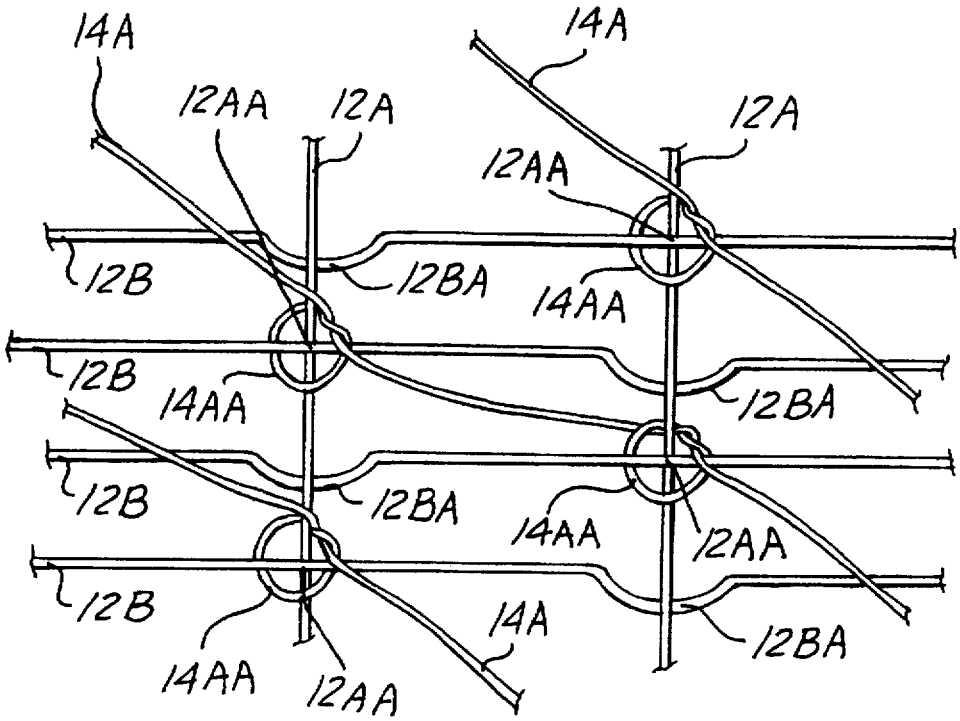
FIG. 3 is a magnified view showing the cushioning material diagonally woven into the normal weave of the nylon-type hosiery.
Figure 4:
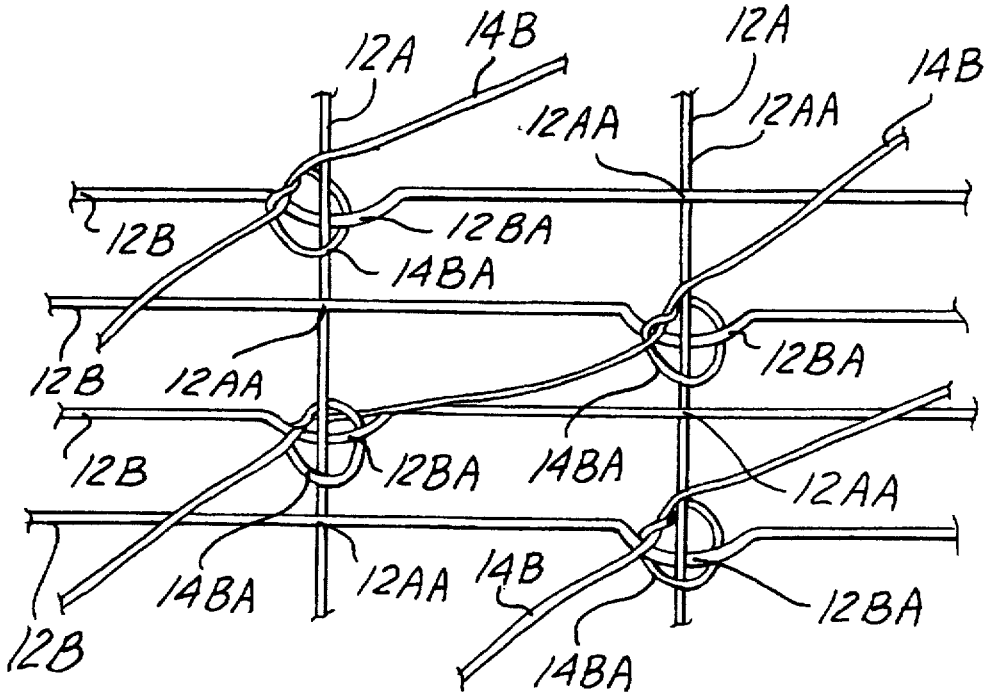
FIG. 4 is a second magnified view showing the cushioning material diagonally woven into the normal weave of the nylon-type hosiery.

Referring now to FIG. 1, the stocking having a comfort foot area of the present invention is designated generally as S. Stocking 8 comprises a nylon-type hosiery stocking 12 having a comfort foot area 10. Stocking 12 has nylon stocking vertical threads 12A and nylon stocking horizontal threads 12B, as shown in FIG. 2. Referring now additionally to FIGS. 3 and 4, comfort foot area 10 comprises a stocking sole 14 having stocking sole left diagonal threads 14A and stocking sole right diagonal threads 14B interwoven or knit into the nylon-type hosiery stocking 12; stocking 12 having nylon stocking vertical threads 12A and nylon stocking horizontal threads 125 weaving together forming a conventional nylon-type hosiery legging 13; and stocking Sole 14 connecting with the nylon legging 13 by integrally weaving or knitting the nylon stocking vertical thread 12A and nylon stocking horizontal threads 12B with the stocking sole left diagonal threads 14A and the stocking sole right diagonal threads 14B.

Now, referring in more detail to FIG. 2, nylon stocking vertical threads 12A weave in a basket-weave motion between the nylon stocking vertical threads under crossing 12AA and the nylon stocking horizontal threads under crossing 12BA. Nylon stocking vertical threads under crossing 12AA weave under the nylon stocking horizontal threads 12B forming a basket-weave pattern. Nylon stocking horizontal threads 12B weave in a basketweave motion between the nylon stocking vertical threads !under crossing 12AA and the nylon stocking horizontal threads under crossing 12BA weaving under the nylon stocking vertical threads 12A forming a basket-weave pattern.

Now, referring in more detail to FIG. 3, stocking sole left diagonal threads 14A traverse diagonally upward in a right to left direction integrally heaving with the nylon stocking vertical threads 12A and nylon stocking horizontal threads 12B. Stocking sole left diagonal threads 14A loop crossing 14AA fastens the stocking sole left diagonal threads 14A to the nylon stocking vertical threads 12A and the nylon stocking horizontal threads 12B at the nylon stocking vertical threads under crossing 12AA.

Now, referring in more detail to FIG. 4, stocking sole right diagonal threads 14B traverse diagonally upward in a left to right direction integrally weaving with the nylon stocking vertical threads 12A and nylon stocking horizontal threads 12B. Stocking sole right diagonal threads 143 loop crossing 14BA fastens the stocking sole right diagonal threads 14B to the nylon stocking vertical threads 12A and the nylon stocking horizontal threads 12B at the nylon stocking horizontal threads under crossing 12BA.

Figure 5:
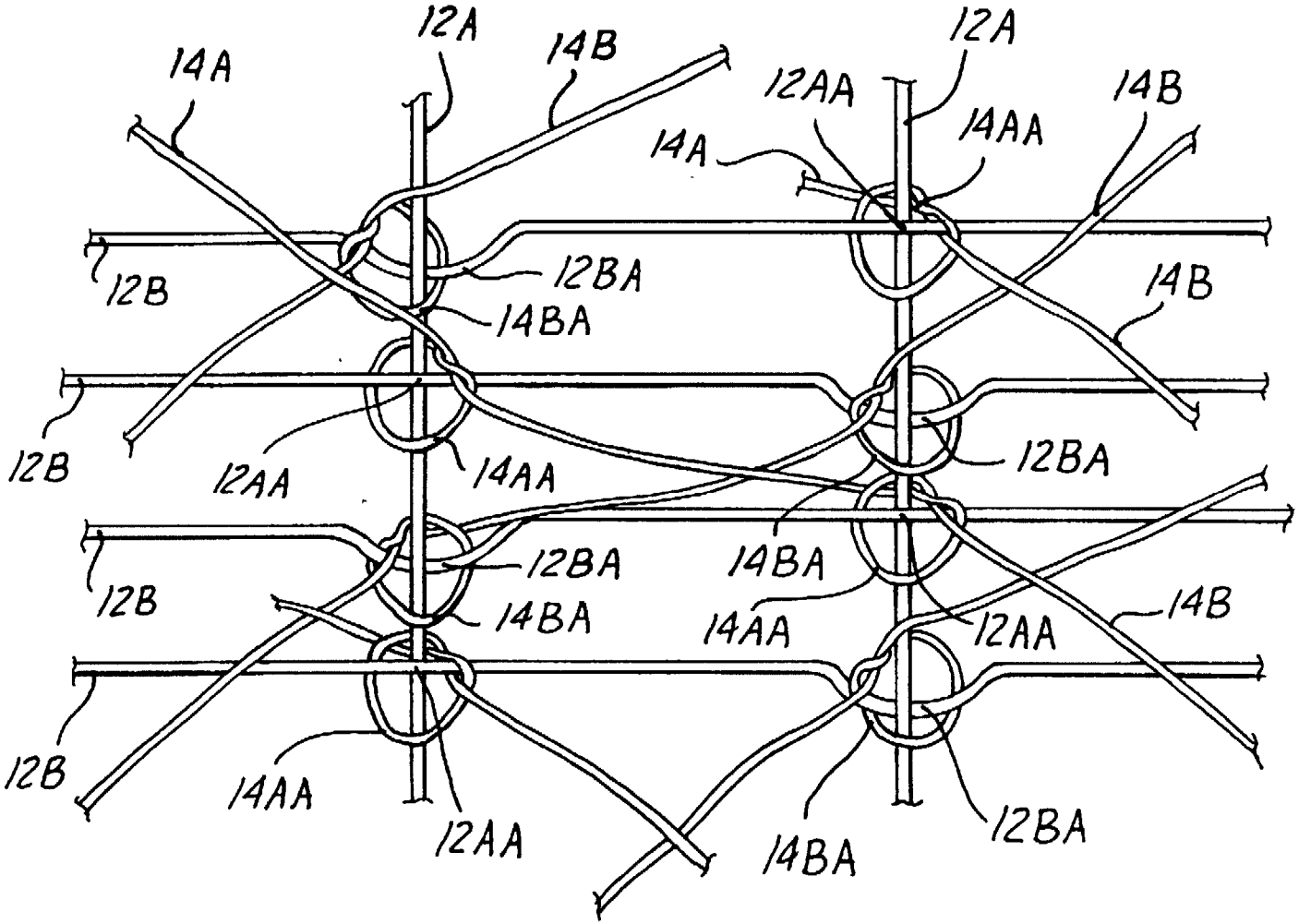
FIG. 5 is a magnified view or the cushioning material cross-woven into the normal weave of the nylon-type hosiery showing the weave pattern.
Figure 6:
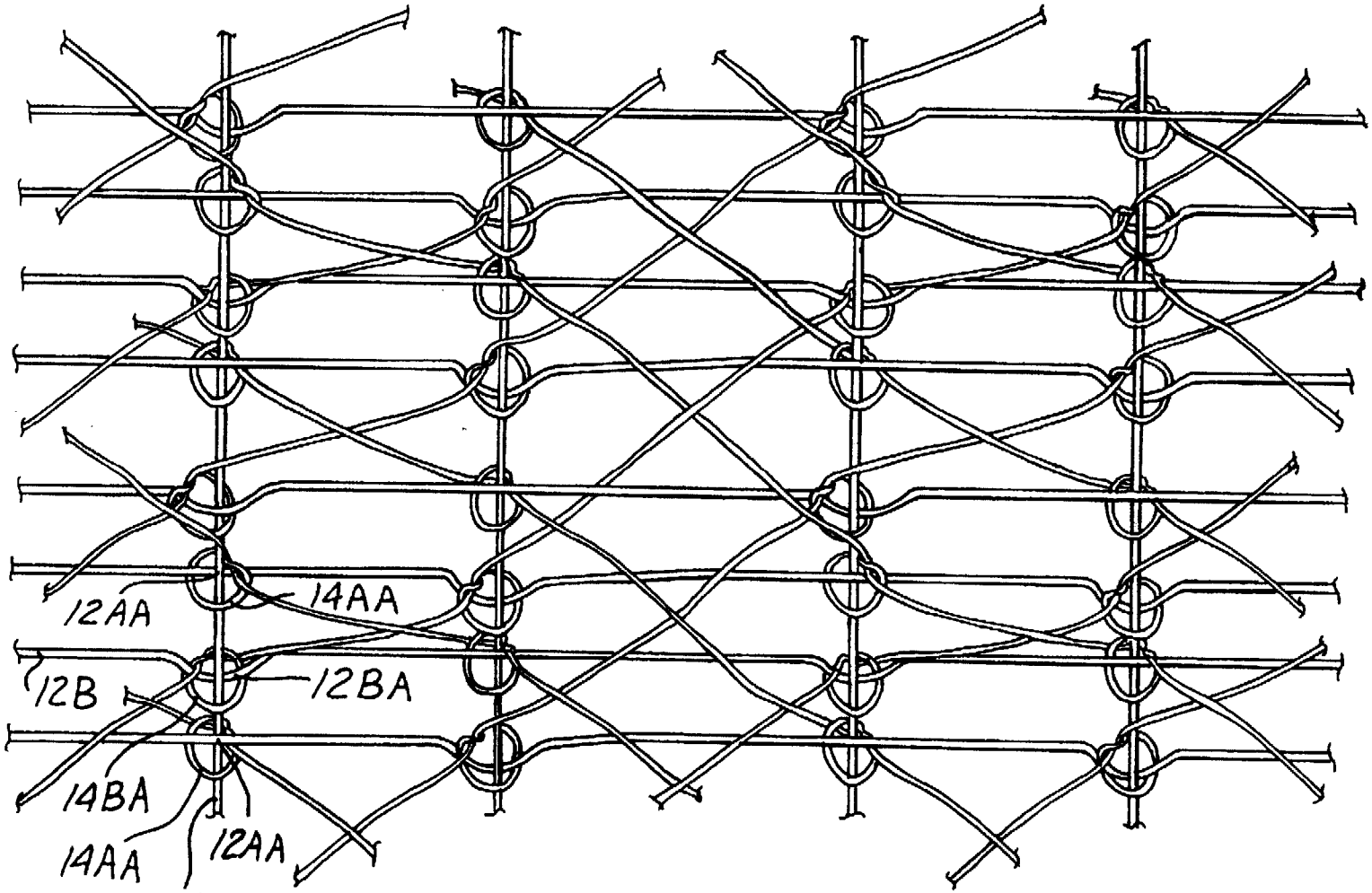
FIG. 6 is a lesser magnified view of the cushioning material cross-woven into the normal weave of the nylon-type hosiery showing the weave pattern.

FIG. 5 shows a magnified view of the comfort material cross-woven into the normal weave of the nylon-type hosiery stocking 12 showing the weave pattern as described in relation to FIGS. 3 and 4 above, thereby forming the comfort foot area 10. Lastly, FIG. 6 is a lesser magnified view of FIG. 5.

It is to be understood that the nylon-type hosiery stocking 12 may be formed from any fine hosiery material, including but not limited to nylon, or any other synthetic material. It is to be further understood teat the nylon-type hosiery stocking 12 may be formed by any suitable means, and in any suitable pattern, some non-limitative exemplary patterns being horizontal, diagonal, loop, skip weave, and standard basket weave.

It is to be further understood that the comfort foot area 10 may be formed from any absorbent fiber material, including but not limited to cotton, cottonblend, wool, fleece, synthetic fibers, or the like.

While preferred embodiments, forms and arrangements of parts of the invention have been described in detail, it will be apparent to those skilled in the art that the disclosed embodiments may be modified. Therefore, the foregoing description is to be considered exemplary rather than limiting and the true scope of the invention is that defined in the following claims.

What is claimed is:

1. A fine hosiery having a comfort foot area, comprising:

a stocking knit from a sheer hosiery fabric material, the stocking having a plurality of stocking vertical threads and a plurality of stocking horizontal threads; and (b) a stocking sole having a plurality of stocking sole left diagonal threads and a plurality of stocking sole right diagonal threads weaving through the plurality of stocking vertical threads and the plurality of stocking horizontal threads integrally forming the comfort foot area and giving aided comfort, cushioning and support to the stocking sole, the stocking sole left diagonal threads and the stocking sole right diagonal threads being formed from an absorbent and cushioning fiber material.

2. The fine hosiery having a comfort foot area as described in claim 1, wherein a user has toe, sole and heel areas of the foot, and wherein the comfort foot area comprises the toe, sole and heel areas.

3. The fine hosiery having a comfort foot area as described in claim 1, wherein the absorbent and cushioning fiber material is selected from the group consisting of cotton, cotton-blend, wool, fleece and synthetic fibers.

4. A method of manufacturing a fine hosiery having a comfort foot area, the method comprising the steps of:

weaving a plurality of vertical and horizontal sheer hosiery fabric material threads in a standard knit pattern to form a stocking; and interweaving a plurality of stocking sole left diagonal threads formed from an absorbent and cushioning fiber material and a plurality of stocking sole right diagonal threads formed from an absorbent and cushioning fiber material in a knotting pattern at each cross point of the knit pattern to form the comfort foot area.

5. A fine hosiery having a comfort foot area, comprising:

a stocking knit from a sheer hosiery fabric material, the stocking having a plurality of stocking vertical threads and a plurality or stocking horizontal threads in a standard box weave over and under pattern, forming junction points therebetween; and a stocking sole positioned at a bottom of the stocking, the stocking sole comprising a plurality of stocking sole left diagonal threads formed from an absorbent and cushioning fiber material and a plurality of stocking sole right diagonal threads formed from an absorbent and cushioning fiber material, the stocking sole left diagonal threads having stocking sole left diagonal thread loop crossings which are knots positioned at each junction point, affixing the stocking sole left diagonal threads to the stocking vertical threads and the stocking horizontal threads in a junction region, the stocking sole right diagonal threads having stocking sole right diagonal thread loop crossings which are knots positioned at each junction point, affixing the stocking sole right diagonal threads to the stocking vertical threads and the stocking horizontal threads in the junction region, the stocking sole forming the comfort foot area.

6. The fine hosiery as described in claim 5 wherein the comfort foot area covers at least one of a toe area, a sole area and a heel area of the stocking.

7. The fine hosiery as described in claim 5 wherein the absorbent and cushioning fiber material is selected from the group consisting of cotton, cotton-blend, wool, fleece and synthetic fibers.

* * * * *